United States Patent [19]

Moskowitz

[11] 4,102,605

[45] * Jul. 25, 1978

[54] FLUID PUMPING DEVICE

[76] Inventor: Seymour Moskowitz, 36 Brandon St., Lexington, Mass. 02173

[ * ] Notice: The portion of the term of this patent subsequent to Mar. 29, 1994, has been disclaimed.

[21] Appl. No.: 761,862

[22] Filed: Jan. 24, 1977

Related U.S. Application Data

[63] Continuation-in-part of Ser. No. 596,506, Jul. 16, 1975, Pat. No. 4,021,148.

[51] Int. Cl.[2] ..... F04F 11/00

[52] U.S. Cl. ..... 417/98; 92/103 R

[58] Field of Search ..... 417/383, 384, 389, 390, 417/395, 388, 367, 394, 93, 96, 98; 92/92

[56] References Cited

U.S. PATENT DOCUMENTS

| | | | |
|---|---|---|---|
| 1,764,712 | 6/1930 | Brackett et al. | 417/439 X |
| 2,505,198 | 4/1950 | Moskowitz et al. | 417/92 |
| 2,619,907 | 12/1952 | Paterson | 92/60 |
| 2,795,196 | 6/1957 | Moskowitz | 417/98 |
| 3,485,176 | 12/1969 | Telford et al. | 417/274 X |
| 4,021,148 | 5/1977 | Moskowitz | 417/383 |

*Primary Examiner*—William L. Freeh
*Assistant Examiner*—Edward Look
*Attorney, Agent, or Firm*—Morse, Altman, Oates & Bello

[57] ABSTRACT

A pump with a plunger assembly that is received within an outer housing containing a fluid. The plunger assembly includes a slidable sleeve portion defining a vertical channel. A pair of thermally conductive, flexible membranes form outer and inner chambers within the vertical channel. One of the flexible membranes is detachably secured to the slidable sleeve portion, the other membrane constituting a common wall that separates the chambers. A charging fluid is fed to the outer chamber through an inlet valve and exits therefrom through an exhaust valve. A fluid to be pumped is fed to the inner chamber through an inlet valve and exits therefrom through an exhaust valve. The charging fluid governs the interior profile within the vertical channel for providing variable pressure to volume ratios within the chamber.

10 Claims, 4 Drawing Figures

FLUID PUMPING DEVICE

CROSS-REFERENCE TO RELATED APPLICATIONS

The present application is a continuation-in-part application of Ser. No. 596,506 filed July 16, 1975 in the name of the applicant hereof for Hydraulic Fluid Device, now Pat. No. 4,021,148.

BACKGROUND OF THE INVENTION

1. Field of Invention

The present invention relates to pumps and, more particularly, is directed towards devices for circulating fluids.

2. Description of the Prior Art

Pumping devices of various configuration have been designed for circulating fluids. One type of pumping device involves the use of a pair of diaphragm pumps which are remotely coupled by a conduit containing an intermediate liquid. The volume of the intermediate liquid in the conduit and chambers of both pumps changes with temperature variation which results in unstable operation of the device. Such pumps have been introduced with varying degrees of success.

SUMMARY OF THE INVENTION

An object of the invention is to provide a pump for circulating a fluid under controlled and variable pressure to volume ratios.

Another object of the invention is to provide a pump with thermally conductive membranes for controlled heat transfer between operating fluids.

A further object of the invention is to provide a pump with a housing that is configured to receive a plunger assembly having a slidable sleeve portion which defines a vertical channel. A membrane within the channel forms inner and outer chambers which are configured to respectively receive a fluid to be pumped and a charging fluid. The charging fluid within the outer chamber controls the interior profile of the inner chamber and provides variable pressure to volume ratios within the chambers.

Yet another object of the invention is to provide a pump with a sealed container adapted to hold a dense fluid. A plunger having an internal vertical channel is slidably received within the container, the vertical channel being opened at its bottom and valved at its top. A thermally conductive member forms two separate chambers with the channel, each chamber containing a fluid.

Still another object is to provide a pump having a sealed housing that is configured to hold a dense fluid. A plunger assembly formed with an interior chamber is slidably received within the housing. A pair of thermally conductive members form inner and outer chambers within the channel, each chamber adapted to receive a fluid. One of the conductive members forms a common wall between the chambers and the other conductive member defines a bottom wall of the inner chamber. The conductive members constitute primary and secondary heat transfer members in accordance with the amount of heat flow across them.

Other objects of the present invention wil in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
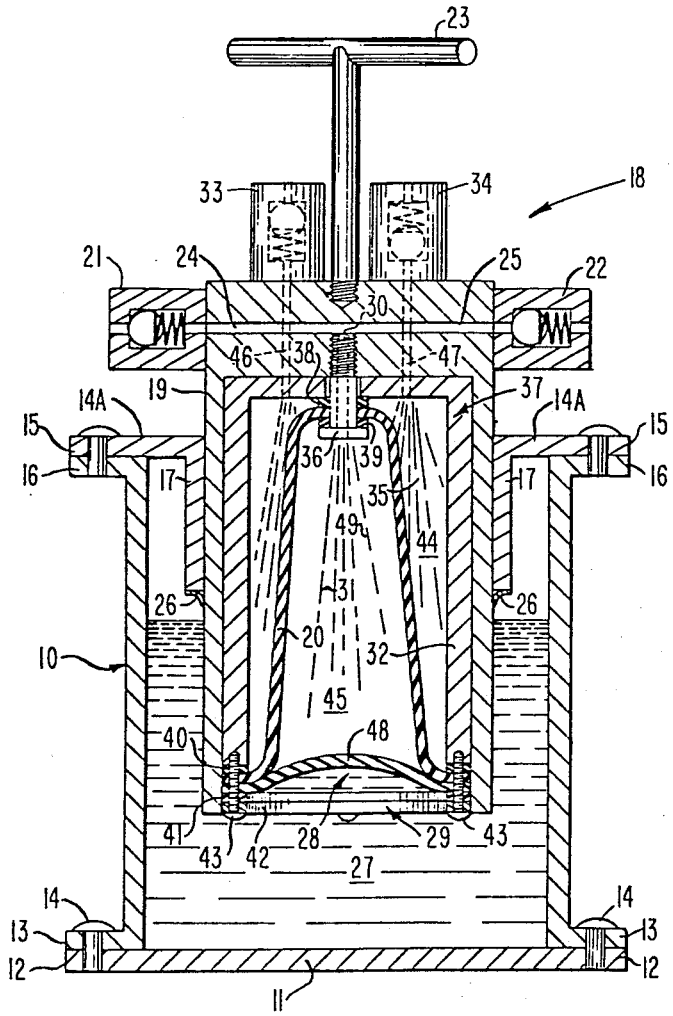
FIG. 1 is a top plan view of a pump enbodying the present invention.
Figure 3:
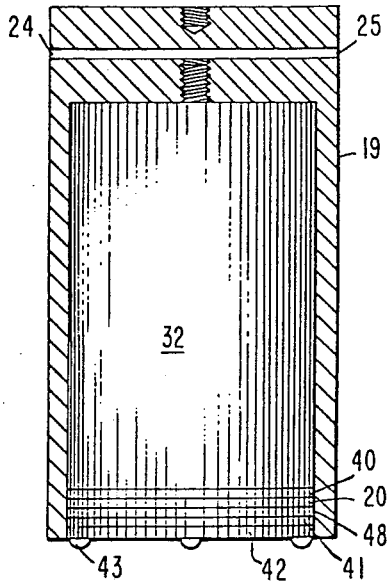
FIG. 3 is a sectional view of the outer sleeve of the pump plunger of FIG. 1.
Figure 2:
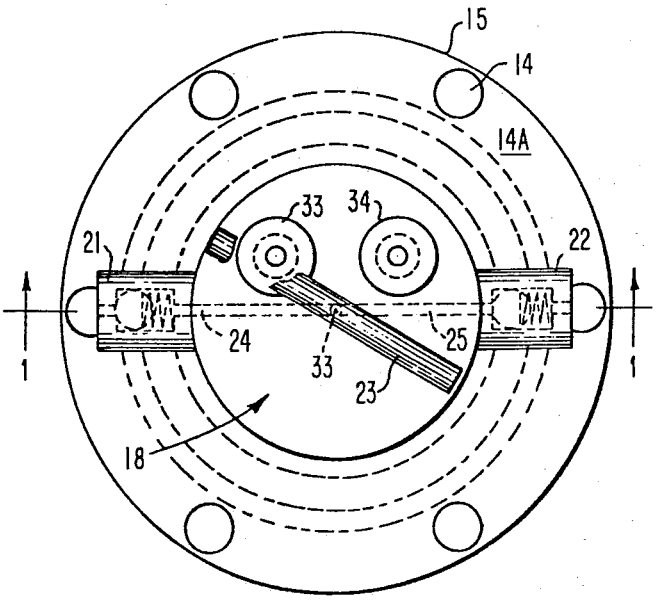
FIG. 2 is a sectional view taken along the lines 2—2 in FIG. 1.

Referring now to the drawings, patricularly FIG. 1, there is shown a housing 10 in the form of a cylindrical container which is provided with a bottom sleeve 11 that is detachably secured in place by cooperating flanges 12, 13 and connecting bolts 14. A top closure 14A for container 10 is detachably secured in place by cooperating flanges 15, 16 and connecting bolts 14. A fixed cylindrical plunger guide 17 extends into container 10 from top closure 14A. A plunger assembly 18 fits slidably into fixed plunger guide 17 and is sealed gas tight by a high pressure seal 26. Plunger assembly 18 includes an outer sleeve 19, an inner sleeve assembly 37, an intake valve 21, an exhaust valve 22, a charging valve 33, an exhaust valve 34 and a handle 23 which is one possible means to reciprocate the entire pump plunger assembly.

The closed upper ends of outer sleeve assembly 19 and inner sleeve assembly 37, which are composed of a metal or plastic or other suitable meterial using conventional techniques, are connected to intake valve 21 and exhaust valve 22 by channels 24, 25 and 30.

Inner sleeve assembly 37 is comprised of an inner sleeve 32, a connecting bolt 36 formed with channel 30 that intersects channels 24 and 25. A pair of cooperating gaskets 38 and 39 are positioned about connecting bolt 36. Inner sleve assembly 37 includes also membrane 20, a lower flexible membrane 48, cooperating gaskets 40 and 41, and an apertured plate 42. Connecting screws 43 detachably secure plate 42, flexible membrane 20, lower flexible membrane 48 and gaskets 40, 41 to the lower end of inner sleeve 32. Connecting bolt 36 detachable secures inner sleeve assembly 37 to outer sleeve 19.

Referring further to inner sleeve assembly 37, flexible membranes 20 and 48 are disposed within a vertical channel 28 and form two distinct free interior volumes or chambers 44 and 45 which completely contain the fluids or gases within them.

Chamber 44 is charged with a fluid or gas 35 by means of charging valve 33 and a channel 46 and the fluid or gas is exhausted by means of a channel 47 and exhaust valve 34. Additionally, by continuously circulating charging fluid 35 within charging chamber 44, an oven effect or heat soak effect is created.

Flexible membranes 20 and 48 may be composed of any suitable material and may be of any predetermined shape to form distinct free interior volumes or chambers with flexible walls within vertical channel 28 of pump plunger assembly 18 which completely contain the fluids or gases within them. Flexible membrane 20 constitutes a common wall of chambers 44 and 45. Chamber 44 is charged with fluid or gas 35 by means of charging valve 33 and channel 46 and is exhausted by means of channel 47 and the exhaust valve 34 to achieve a desired interior profile within plunger assembly 18 at any instant of time which may be varied instantaneously and at will depending on the pressure and the amount of the charging fluid or gas that is used and the flexibility of the membrane or the ability of the membrane to stretch. In the preferred embodiment, the pressure within chamber 44 is greater than the pressure within chamber 45 so that membrane 20 constitutes a less flexible or stiffer wall of chamber 45 which contains a fluid or gas 49 to be pumped.

In one embodiment, flexible membranes 20 and 48 are composed of a plastic material having a thickness in the range of 2 to 20 mils and a thermal conductivity in the range of 0.10 to 0.19 BTU/hr/sq. ft./° F/ft. Specific plastic materials and their thermal conductivities are as follows:

| Plastic | Thermal conductivity BTU/hr/sq. ft./° F/ft. |
|---|---|
| Polytetrafluoroethelyne | .15 |
| Thermoplastic polycarbonate resin | .115 |
| Polyethelyne terephthalate resin | .12–.10 |
| Polyethelyne | .19 |

In another embodiment, flexible membranes 20 and 48 are composed of an elastomer, for example natural or synthetic rubber, having a thickness in the range of 2 to 20 mils and a thermal conductivity in the range of 0.05 to 0.12 BTU/hr/sq. ft./° F/ft. Specific elastomeric materials and their thermal conductivities are as follows:

| Elastomeric | Thermal Conductivity BTU/hr/sq.ft./° F/ft |
|---|---|
| natural rubber | .08 |
| neoprene rubber | .11 |
| silicone rubber | .12–.11 |
| butyl rubber | .05 |

In still another embodiment, flexible membranes 20 and 48 are composed of a metal having a thickness in the range of 5 to 20 mils and a thermal conductivity in the range of 21.7 to 226 BTU/hr/sq. ft./° F/ft. Specific metals and their thermal conductivities are as follows:

| Metal | Thermal Conductivity BTU/hr/sq.ft./° F/ft |
|---|---|
| Metal aluminum and its alloys | 135–67.4 |
| phosphor bronzes | 120–29 |
| berrylium copper | 110–100 |
| alloy steels | 38.5–21.7 |
| tin and its alloys | 65.3–60.5 |
| copper | 226–196 |

Container 10 is filled with a fluid 27 to such a level that, at the top of the stroke of plunger assembly 18, the bottom of vertical channel 28 is immersed in fluid 27. Vertical channel 28 may vary in cross-sectional area from its opened lower end to its closed and valved upper end. Above fluid 27 and within chamber 45 is fluid or gas 49 which is being pumped or circulated.

When plunger assembly 18 is moved downwardly, fluid or gas 49 is displaced from chamber 45 as fluid 27 rises through apertured plate 42 in channel 28 due to the pressure exerted upon fluid 27, pumped fluid 49, and a charging fluid 25. This pressure can only be relieved as pumped fluid 49 escapes through exhaust valve 22.

As plunger assembly 18 is moved upwardly, pumped fluid or gas 49 is drawn into channel 24, 30 and chamber 45. That is, the pressure within channels 24, 30 and chamber 45 is reduced and the partial vacuum thus formed is relieved as the pumped fluid or gas flows therein through intake valve 21.

As fluid 27 rises and falls in the channel 28, drawing in and then exhausting pumped fluid or gas 49 through intake valve 21 and exhaust valve 22, flexible membrane 20 expands or stretches as fluid 27 rises and falls in the channel. The cross-sectional area of chamber 45 may be varied instantaneously and at will by simultaneously and selectively controlling charging valve 33 and relief or exhaust valve 34 for specifying the pressure and quantity of charging fluid or gas 35. Additionally, relief valve 34 may be used to discharge the fluid or gas from within chamber 45, thereby allowing the flexible membrane to relax to some desired intermediate profiles as a predetermined amount of fluid or gas is released. Also, charging valve 33 may be employed to charge the fluid or gas within chamber 45 to a higher pressure to cause flexible membrane 20 to expand or stretch to achieve a desired interior profile within the channel. Therefore, if the surface of fluid 27 on lower flexible membrane 48 is considered as a piston face doing work on pumped fluid 49 and channel 28, a given amount of force on this piston face may either pump a smaller amount of the pumped fluid at a higher pressure or a larger amount of the pumped fluid at a lower pressure depending on the cross-sectional area of chamber 45 which may be varied instantaneously and at will. The cross-sectional area of chamber 45 determines the area of the hypothetical piston face. As the configuration of chamber 45 varies, the pump may have different and variable pressure to volume ratios in the different parts of a single stroke which may be predetermined or altered as desired in the different parts of the single stroke while a given force or thrust moves the piston, i.e., the surface of fluid 27 upon lower flexible membrane 48 in channel 28.

Membrane 20 and lower flexible membrane 48 may be thermally conductive to conduct heat away from or transmit heat to fluid or gas 49 which is being circulated. The rate of heat flow in British Thermal Units per unit time. B.T.U.'s per hour or BTU's per minute or B.T.U.'s per second, through membranes 20 and 48 is dependent upon the materials of which membranes 20 and 48 are composed of, the thickness of membranes 20 and 48, the areas of membranes 20 and 48, and the temperature in degrees Fahrenheit or in degrees Centigrade at the surfaces of membranes 20 and 48. If $T_1$ is the temperature at one surface of a membrane and $T_2$ is the temperature at the opposite surface of the membrane and if $T_1$ is greater than $T_2$, then the rate of heat flow through the membrane would be dependent upon and proportional to the temperature difference $T_1$ minus $T_2$. Further, in accordance with the laws of thermodynamics, thermal energy is transmitted through the membrane from that surface at the higher temperature $T_1$ to the opposite surface at the lower temperaute $T_2$.

The rates of heat flow through membrane 20 and lower flexible membrane 48 may be different from one another. The membrane across which the greater rate of heat flow occurs, B.T.U.'s per unit time, may be designated as the Primary Heat Transfer Membrane and the membrane across which the less rate of heat flow occurs, B.T.U.'s per unit time, may be designated as the Secondary Heat Transfer Membrane.

Figure 4:
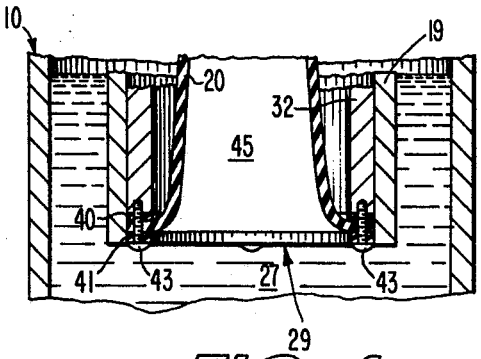
FIG. 4 is a detailed sectional view of an alternate embodiment of the pump of FIG. 1 with the lower flexible membrane removed.

Since the membranes may posses a thermal conductivity, they would also possess a thermal impedance or resistance to the flow of heat. If the circulated fluid or gas 49 is inert and does not react in a harmful manner with fluid 27 within container 10, lower flexible membrane 48 may be removed from inner sleeve assembly 37, as in FIG. 4, to remove the thermal impedance of the lower flexible membrane to the flow of heat between circulated fluid or gas 49 and the fluid 27. Such an embodiment of the invention is shown in FIG. 4.

A wide selection of membrane may be used with any given pump plunger assembly. The membranes are replaceable within the pump plunger assembly if they tear or leak and any desired shape of membrane of any desired material or combination of materials may be used at any given time to achieve a desired interior profile when charged or inflated with a charging fluid or gas. The membranes may be formed by any suitable fabrication process, as for instance, they may be molded or they may be cut, formed and joined together by adhesive bonding or a vulcanizing process may be employed. The membranes may be thermally conductive for conducting heat away from or tramsmitting heat to the pumped fluid or gas by using fluid 27 as either a heat sink for a heat source, or by employing the charging fluid as with a heat sink or a heat source, or by simultaneously employing both the charging and working fluids as heat sinks and/or heat sources to establish any desired temperature within the fluid or gas being circulated. The thermal conductivity of the membranes may thus be used to affect the state point (pressure, volume, temperature) of the fluid or gas being pumped or circulated.

There are two necessary characteristics of fluid 27, and charging fluid or gas 35 and the pumping fluid 49. Firstly, fluid 27 within container 10 has a greater density than the pumped fluid or gas. Secondly, all of the fluids or gases employed do not mix or react in a harmful manner with each other or with the membranes.

In one example, the pumping fluids and charging fluids are mercury pumping oil, water or air. In another example, water is used as the fluid within the container and as the charging fluid to pump light oils, or it is used to pump air or oxygen. It is to be understood that there are any number of possible combinations of fluids within the container and charging fluids or gases and pumped fluids or gases that by me used to practice this invention.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A fluid pumping device comprising a closed container configured to receive a fluid, plunger means received within said container and constrained for movement relative thereof, said plunger means including sleeve means forming an interior channel and thermally conductive, flexible membrane means, said sleeve means constrained for movement within said container, said flexible membrane means connected to said sleeve means and forming at least first and second chambers within said channel, at least a portion of said second chamber disposed within said first chamber, said first chamber constituting a charging chamber and said second chamber constituting a pumping chamber, first inlet means and first outlet means communicating with said charging chamber, second inlet means and second outlet means communicating with said pumping chamber, said second inlet and outlet means including valve means, at least a portion of said flexible means constituting a common wall between said charging chamber and said pumping chamber, a fluid to be pumped entering said pumping chamber through said second inlet means and exiting said pumping chamber through said second outlet means, a charging fluid entering said charging chamber through said first inlet means and exiting said charging chamber though said first outlet means, said thermally conductive, flexible membrane means operative to control heat transfer between said pumping fluid and said charging fluid, variable pressure to volume ratios are provided by controlling said charging fluid entering and exiting said charging chamber as said plunger means moves within said container and said fluid to be pumped enters said pumping chamber through said second inlet means and exits said pumping chamber through said second outlet means.

2. The device as claimed in claim 1 wherein said first chamber is a closed chamber and said second chamber is an open ended chamber.

3. The device as claimed in claim 1 wherein said first and second chambers are sealed chambers.

4. The device as claimed in claim 1 wherein said thermally conductive, flexible membrane means includes first and second, thermally conductive, flexible membranes, said first membrane constituting a common wall between said first and second chambers, said second membrane constituting a common wall between a fluid received within said container and said second chamber.

5. The device as claimed in claim 1 wherein said thermally conductive, flexible membrane means is composed of a material having a thermal conductivity in the range of 0.05 to 226 BTU/hr/sq. ft./° F/ft.

6. A hydraulic fluid device comprising a closed container with an interior compartment configured to hold a fluid, a guide at an upper section of said container, plunger means received within said guide; said plunger including a sleeve forming a vertical channel and thermally conductive, flexible membrane means, said sleeve constrained for movement relative to said guide, said flexible membrane means connected to said sleeve and forming at least first and second chambers within said vertical channel, said second chamber within said first chamber, said first chamber constituting a charging chamber and said second chamber constituting a pumping chamber, first inlet means and first outlet means communicating with said charging chamber, second inlet means and second outlet means communicating with said pumping chamber, said second inlet means and said second outlet means including valve means, at least a portion of said flexible means constituting a common wall between said charging chamber and said pumping chamber, a fluid to be pumped entering said pumping chamber through said second inlet means and exiting said pumping chamber through said second outlet means, a charging fluid entering said charging chamber through said first inlet means and exiting said charging chamber through said first outlet means, said thermally conductive, flexible membrane means operative to control heat transfer between said pumping fluid and said charging fluid, variable pressure to volume ratios are provided by controlling said charging fluid entering and exiting said charging chamber as said plunger means moves within said container and said fluid to be pumped enters said pumping chamber through said second inlet means and exits said pumping chamber through said second outlet means, said charging fluid within said charging chamber at a pressure which is higher than the pressure of said pumping fluid within said pumping chamber.

7. The device as claimed in claim 6 wherein said second chamber is opened at one end, said open end of said second chamber communicating with said interior compartment.

8. The device as claimed in claim 6 wherein said thermally conductive, flexible membrane means is composed of a material having a thermal conductivity in the range of 0.05 to 226 BTU/hr/sq. ft./° F/ft.

9. The device as claimed in claim 8 wherein said flexible membrane means has a thickness in the range of 2 to 20 mils.

10. The device as claimed in claim 6 wherein said thermally conductive, flexible membrane means includes at least first and second membrane means, said first membrane constituting a common wall between said first and second chambers, said second membrane constituting a common wall between said second chamber and said interior compartment.

* * * * *